United States Patent [19]

Oddicini et al.

[11] 4,172,672

[45] Oct. 30, 1979

[54] DEVICE FOR FACILITATING LOCATION OF THE PRINTING POINT AND/OR CORRECTION OF CHARACTERS

[75] Inventors: Giuseppe Oddicini, Banchette; Pasquale Crosio, Strambino, both of Italy

[73] Assignee: Ing. C. Olivetti & C., S.p.A., Ivrea, Italy

[21] Appl. No.: 788,419

[22] Filed: Apr. 18, 1977

[30] Foreign Application Priority Data

Apr. 27, 1976 [IT] Italy ..... 68018 A/76
Apr. 27, 1976 [IT] Italy ..... 68019 A/76

[51] Int. Cl.[2] ..... B41J 29/42

[52] U.S. Cl. ..... 400/709; 400/697.1; 400/536; 400/309; 400/161; 400/206; 400/214

[58] Field of Search ..... 197/16, 91, 135 R, 181, 197/187, 188, 190

[56] References Cited

U.S. PATENT DOCUMENTS

| | | | |
|---|---|---|---|
| 807,746 | 12/1905 | Kelley | 197/190 |
| 836,944 | 11/1906 | Persson | 197/190 |
| 922,547 | 5/1909 | Vincent | 197/190 |
| 1,574,980 | 3/1926 | Lindburg | 197/135 R |
| 1,588,894 | 6/1926 | Kurowski | 197/135 R |
| 3,288,262 | 11/1966 | Salto | 197/91 X |
| 3,397,767 | 8/1968 | Hobbs | 197/181 |
| 3,595,362 | 7/1971 | Wolowitz | 197/181 |
| 3,724,633 | 4/1973 | Korb et al. | 197/181 X |
| 3,729,081 | 4/1973 | Ozimek et al. | 197/181 X |
| 3,747,734 | 7/1973 | Norman et al. | 197/181 |
| 3,770,095 | 11/1973 | Guerrini et al. | 197/16 UX |
| 3,788,442 | 1/1974 | Lehnhardt et al. | 197/181 |
| 3,799,316 | 3/1974 | Davidge et al. | 197/181 |
| 3,828,909 | 8/1974 | Roano et al. | 197/16 |
| 3,834,512 | 9/1974 | Haugen | 197/181 |
| 3,882,990 | 5/1975 | Genesio | 197/181 |
| 3,887,055 | 6/1975 | Pastrick | 197/135 R |
| 3,997,046 | 12/1976 | Wolowitz | 197/181 |

OTHER PUBLICATIONS

IBM Technical Disclosure Bulletin, "Card Holder For Correcting Typewriter", Buckley et al., vol. 15, No. 11, Apr. 1973, p. 3395.

*Primary Examiner*—Ernest T. Wright, Jr.
*Attorney, Agent, or Firm*—Schuyler, Birch, McKie & Beckett

[57] ABSTRACT

A device for facilitating location of the printing point and/or the correction of characters comprises a mechanism actuated by a back space key to shift the printing point back. A second mechanism, also actuated by the back space key, moves a pointer to a set position over the printing point simultaneously with the back spacing. A restoring element controlled by a typing mechanism automatically restores the pointer to an inoperative position clear of the printing point before the typing of the selected character. A correcting key, when actuated, sets a suppressor which arrests the movement of a spring actuated actuator to lock the escapement and prearranges a lift mechanism for raising a correcting ribbon into an operative position. A positioner connected to the lift mechanism holds the suppressor in the set position in opposition to the action of a returning spring when the mechanism is prearranged for use and releases the suppressor when the correcting ribbon is raised into the operative position. During its actuation, the actuator replaces the positioner to hold the suppressor in the set position, when the correcting ribbon is in the raised position, and at the end of its actuation, releases the suppressor for its return to the inoperative position through the medium of the return spring.

15 Claims, 11 Drawing Figures

DEVICE FOR FACILITATING LOCATION OF THE PRINTING POINT AND/OR CORRECTION OF CHARACTERS

BACKGROUND OF THE INVENTION

The present invention relates to a typewriter with a device for facilitating location of the printing point and/or the correction of characters, a typewriter referring herein to any office machine incorporating a keyboard operated typing mechanism. A typewriter with proportional spacing is known, wherein a back-spacer shifts the printing point back and a changeover lever arranges a pointer in correspondence with the printing point and prearranges blank typing for facilitating justification of a line and exactly indicating a chosen position for correction of a character. This device has the disadvantage of requiring fresh actuation of the changeover lever after the depression of the back-spacer for reinstating the typing or printing of characters after the positioning of the printing point.

One object of the present invention is to provide a typewriter with a device for facilitating location of the printing point which is simple and reliable and which does not require additional manipulations from the operator during the stages of back spacing and typing.

Another object of the invention is to facilitate the correction of a typed character, in particular, in machines providing proportional spacing.

Another object is to provide a device for facilitating the correction of typed characters which is simple, reliable and of relatively small cost.

SUMMARY OF THE INVENTION

According to the present invention, there is provided a typewriter having a device for facilitating location of the printing point, comprising a mechanism actuated by a back-space key to shift the printing point back, a second mechanism also actuated by the back-space key to move a pointer to a set position over the printing point simultaneously with the back-spacing, and a cancelling element controlled by a typing mechanism of the typewriter which automatically restores the pointer to an inoperative position clear of the printing point before the typing of the selected character.

Further, according to the invention, there is provided a typewriter with a correcting device, wherein, in a typing cycle, spacing takes place through the agency of a spring-actuated actuator controlling an escapement and a correcting key, when actuated, sets a suppressor which arrests the movement of the actuator to lock the escapement and prearranges for actuation a mechanism which raises a correcting ribbon into an operative position, comprising a positioner connected to the mechanism raising the correcting ribbon so as to hold the suppressor in the set position in opposition to the action of a return spring when the said mechanism is prearranged for use, and release the suppressor when the correcting ribbon is raised into the operative position, and in that during its actuation the actuator replaces the positioner to hold the suppressor in the set position when the correcting ribbon is in the raised position and, at the end of its actuation, releases the suppressor for its return to the inoperative position through the medium of the return spring.

BRIEF DESCRIPTION OF THE DRAWING

The invention will be described in more detail, by way of example, with reference to the accompanying drawing, in which.

DESCRIPTION OF THE PREFERRED EMBODIMENT

Figures 1, 2:
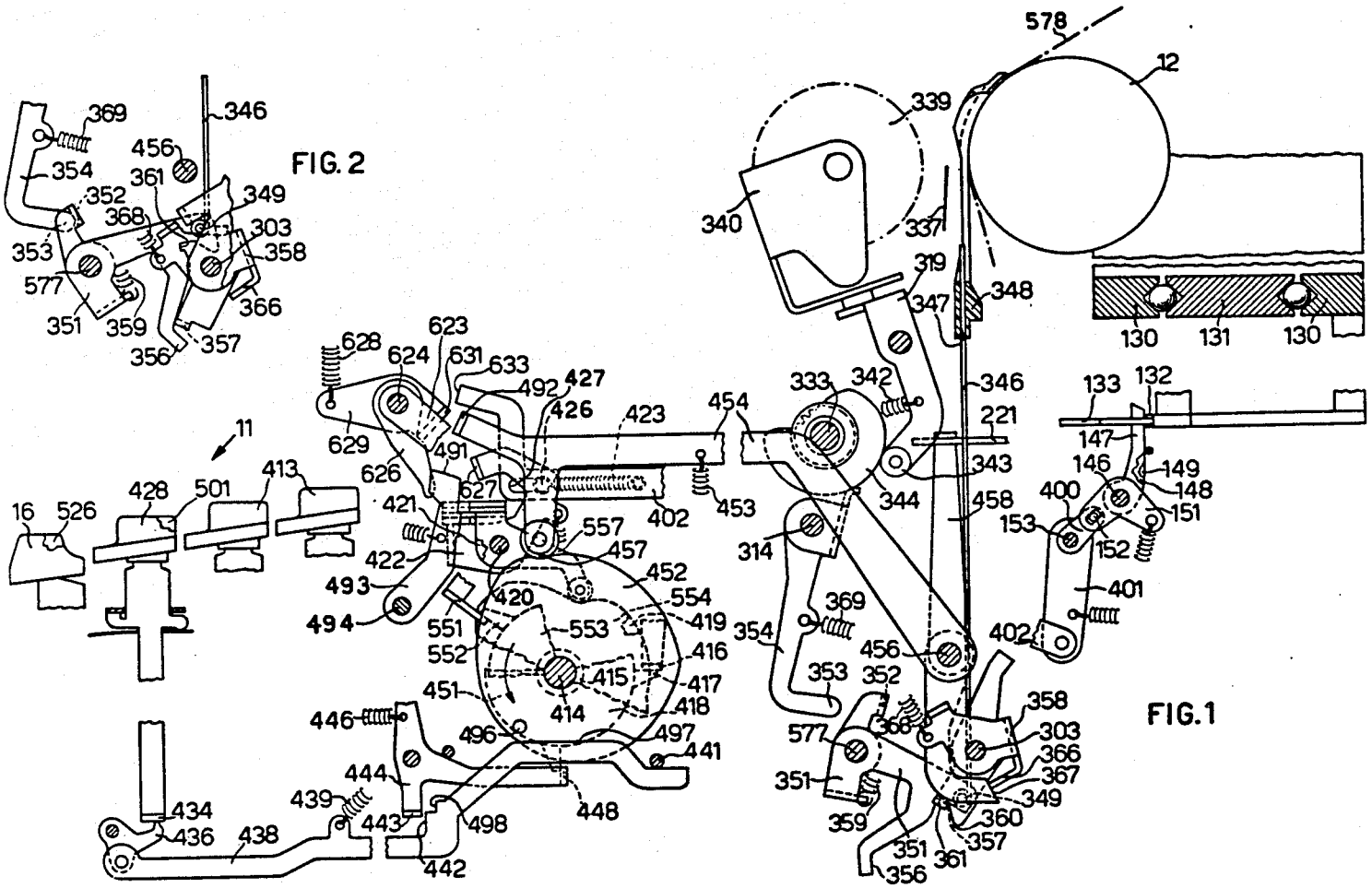
FIG. 1 is a partial longitudinal section of a typewriter embodying the invention.
FIG. 2 is a view of a detail of FIG. 1 shown in a working position.

The illustrated device is incorporated by way of example in an electric typewriter having a keyboard 11 (FIG. 1), a typing head 339 and a carriage 130 with a platen 12. The keyboard 11 is substantially like that described in U.S. Pat. No. 3,828,909 and comprises a set of alphanumeric keys 413 and function or service keys among which are a correcting key 16, a space bar 526 and keys 428 and 501 for return or back spacing by one step and by half a step, respectively.

The typing head 339 is of the barrel type, e.g. of the kind described in U.S. Pat. No. 3,770,095 and bears types or characters distributed in rows and columns. The head 339 is rotatable horizontally in a fork 340 for selection of the rows and the fork 340, in turn, is rotatable vertically on a frame 319 for selection of the columns. A spring 342 normally holds the frame 319 swung clockwise with a roller 343 bearing against a striking cam 344 fast with a shaft 333.

On the depression of an alphanumeric typing key 413, a lug 416 releases a dog 417 of a typing clutch 418 driven by a driving shaft 414, which starts a 180° typing cycle of a sleeve 415.

Figures 10, 11:
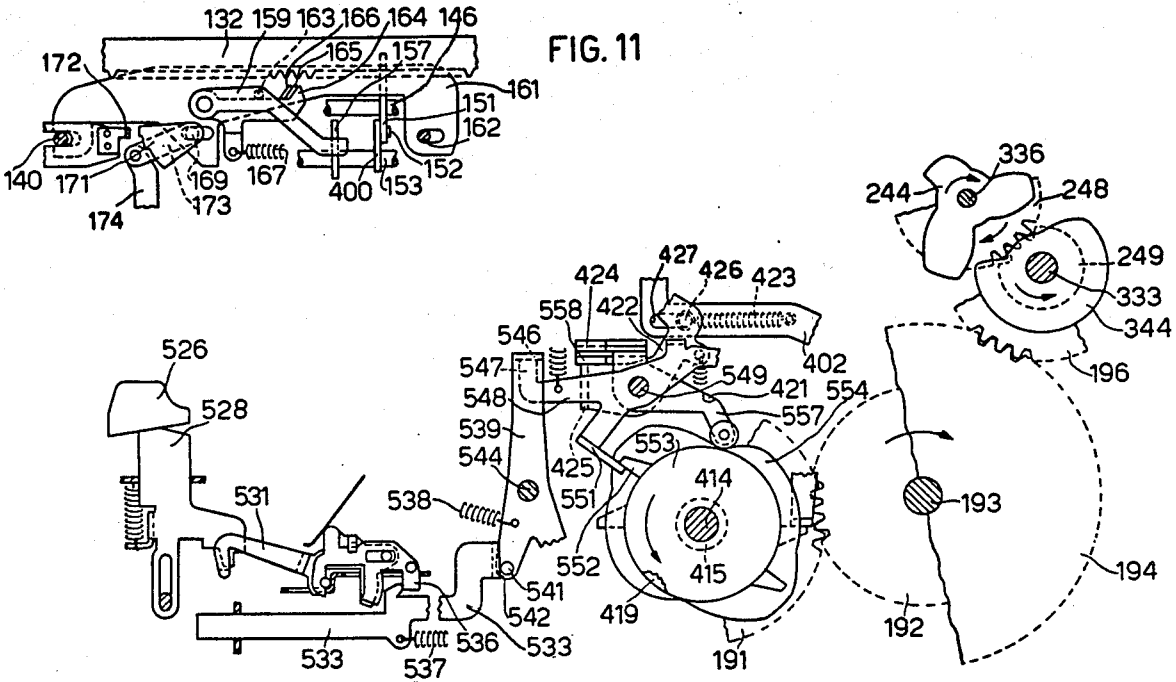
FIG. 10 is a partial longitudinal section of the typewriter of FIG. 1.
FIG. 11 is a partial plan view of a number of details of the typewriter of FIG. 1.

The machine is provided with a selector device, substantially similar to that described in U.S. Pat. No. 4,067,429 incorporated herein as reference, which selects the row and column of the character to be typed or printed by the head 339. The sleeve 415 (FIG. 10) is integral with a gear 191 engaged with a gear 192 of a shaft 193. A gear 194 integral with the gear 192 is engaged with a gear 196 of the shaft 333. In this manner, the 180° cycle of the sleeve 415 (FIG. 1) causes the striking cam 344 to rotate through 360° so as to permit the spring 342 to turn the frame 319 clockwise, causing the head 339 to strike against the platen 12 for printing the selected character through the medium of an inked ribbon 337.

The feed and the raising of the ribbon 337 are effected as described in U.S. Pat. No. 4,033,445. More particularly, two ribbon-raising forks 236 (FIG. 4) are fast with a hub 241 rotatable on a spindle 242 and guide the ribbon 337. One of them has a roller 243 adapted to co-operate under the action of a spring 247 with a three lobed cam 244 having three lobes of different heights, which is fixed on a shaft 336 and is connected with the shaft 333 (FIG. 10) through a pair of gears 248 and 249 with a transmission ratio of one revolution to three between the cam 244 (FIG. 4) and the shaft 333 (FIG. 1). In this way, at each typing cycle, the cam 244 (FIG. 4) rotates through 120° and the three lobed cam 244 raises the ribbon 337 to different heights, utilizing the entire width of the ribbon 337.

The machine is provided with a variable spacing device substantially similar to that described in U.S. Pat. No. 3,288,262.

SPACING

Figure 8:
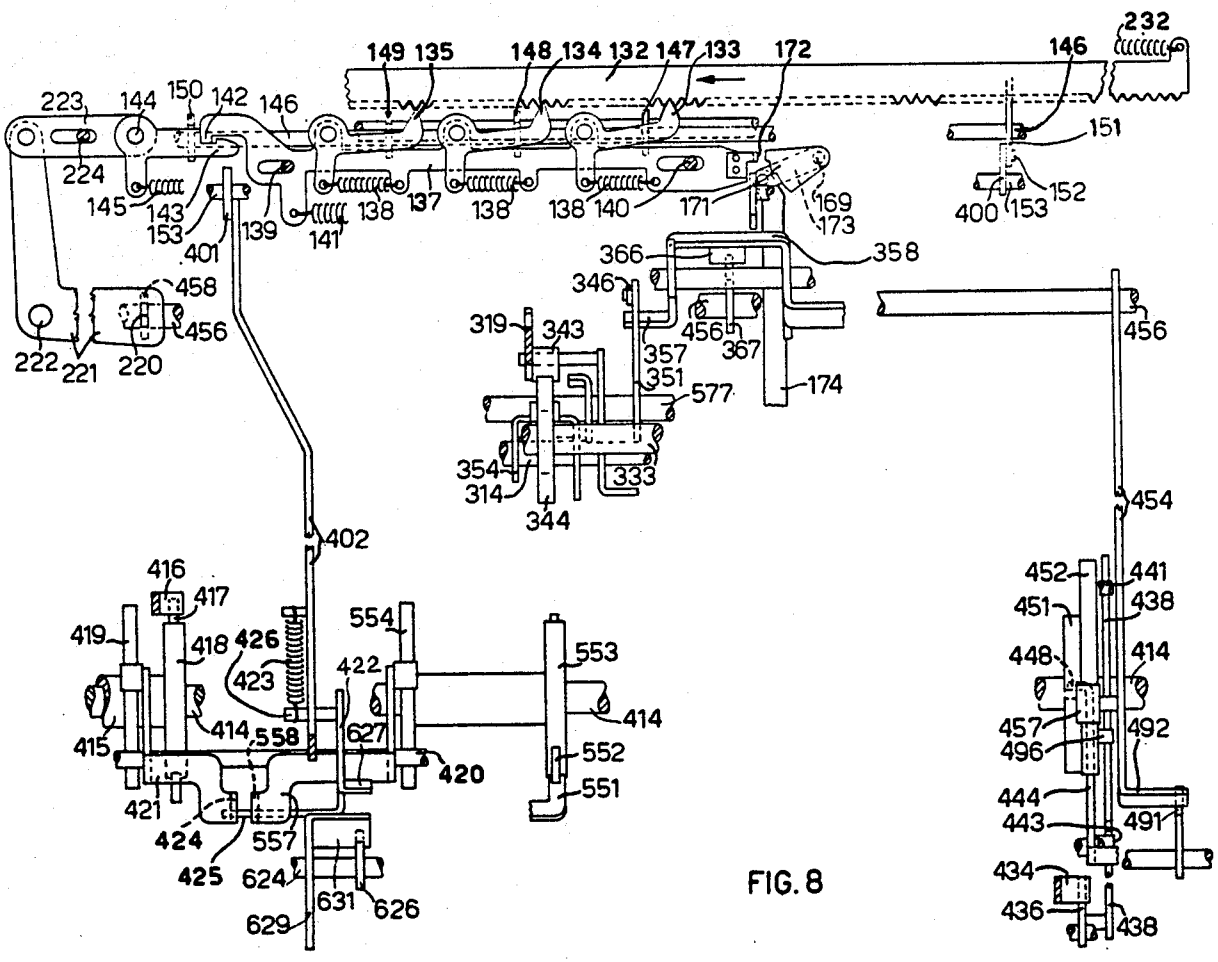
FIG. 8 is a partial plan view of the devices of FIGS. 1 and 3.

The cylinder or platen 12 (FIG. 1) is mounted on a carriage 130 slidable transversely on a guide 131 fixed to the machine. The carriage 130 bears a rack 132 having a pitch equal to three times one elementary step and is pulled to the left by a spring 232 (FIG. 8). Character spacings are two, three or four elementary steps. Under the action of springs 138, the rack 132 is normally engaged by one of three escapement pawls 133, 134 and 135 pivoted on a slider 137 and spaced by two intervals which differ from an integral number of rack pitches by one and two elementary steps respectively. The slider 137 is slidable on two fixed pins 139 and 140 and is urged to the right by a spring 141, the slider 137 bearing normally against the pin 139, being held to the left as now described. The slider 137 is moreover provided with a projection 142 engaged by a hook 143 pivoted on a pin 144 and biased by a spring 145. A plate 171 (FIG. 8) is turned by a slider 174, a crank 173 and a rod 169 and arranges one of three steps thereon in front of a projection 172 of the slider 137 to effect selection of the spacing as described in the U.S. Pat. No. 3,288,262.

In the meantime, an escapement cam 419 (FIG. 8) carried by the sleeve 415 moves a cam-following lever 421. The lever 421 is pivoted on a shaft 420 and through a tongue 424 cooperates with a tongue 425 of a lever 422, also pivoted on shaft 420. The rotation of lever 421 causes anti-clockwise rotation of the lever 422 in FIG. 1. The lever 422 is provided with a pin 426, connected through a spring 423 and a slot 427 with an actuator or pull rod 402. The rod 402 (FIG. 8) is fulcrumed on a lever 401, so that rotation of the lever 422 causes the lever 401 to turn clockwise together with a shaft 153. A lever 400 fixed to the shaft 153 rotates a crank 151 by means of a pin 152 and, by means of a shaft 146 and arms 147, 148 and 149, the crank 151 disengages the escapement pawls 133, 134 and 135 (FIG. 8) from the rack 132. Moreover, an arm 150 on the shaft 146 causes clockwise rotation of the hook 143, which releases the projection 142 of the slider 137. The carriage 130 moves to the left under the action of the spring 232, while the slider 137 travels to the right until the projection 172 encounters the plate 171. The escapement cam 419 then allows the levers 421 and 422 and, therefore, the lever 401 to return to the rest or inoperative position. The rack 132 now carries whichever one of the escapement pawls 133, 134 and 135 has already engaged to the left together with the slider 137, until the latter is arrested against the fixed pin 139, its projection 142 re-engaging the hook 143. Three escapement pawls 133, 134 and 135 as in the U.S. Pat. No. 3,288,262 can be provided to avoid the skipping of a tooth. The travel of the slider 137 to the left depends on which step of the plate 171 had engaged the projection 172 and will amount to two, three or four elementary steps, according to the character that is typed, different keys 413 being arranged to rotate the plate 171 to different ones of its three positions.

The space bar 526 (FIG. 1) is connected through a shank 528 (FIG. 10) with a lever 531 and with a slider 533 as described in the cited U.S. Pat. No. 3,828,909. The slider 533 is kept by a hook 536 against the urging of a spring 537. A spring 538 holds a lever 539 arrested with a pin 541 against a shoulder 542 of the slider 533. The lever 539 is pivoted on a pin 544 and with a lug 546 cooperates with a shoulder 547 of a lever 548 which is pivoted on a shaft 549 and comprises a lug 551 which arrests a dog 552 of a spacing clutch 553. The clutch 553 bears a spacing cam 554 substantially similar to the escapement cam 419 with which a cam-following lever 557 similar to the lever 421 co-operates. This lever 557 is adapted to cooperate through a tongue 558 with the tongue 425 of the lever 422 and therefore with the pull rod 402 for an escapement cycle equal to two elementary steps.

RETURN BY ONE STEP

A device for return or back spacing by one step comprises a key 428 (FIG. 1) adapted to close or engage a service clutch 451 for a 360° cycle to rotate a cam 452, FIGS. 1 and 8. The cam 452 co-operates under the action of a spring 453 with a roller 457 of a lever 454 which can turn on a shaft 456. A lever 458 fixed on the shaft 456 engages in a slot 220 (FIG. 8) of a horizontal lever 221 pivoted at 222. The lever 221 is connected to a slider 223 slidable on a fixed pin 224 and bearing the pivot 144 of the hook 143. Three retaining dogs 164, 165 and 166 (FIG. 11) and a lever 159 are supported on a support 161 mounted on fixed pins 162 and 140. The lever 159 cooperates with a lever 157 fixed on the shaft 153.

On depressing the key 428 (FIG. 1) for return by one step, a lug 434 of the key 428 shifts a slider 438 to the left in FIG. 1 by means of a lever 436 in opposition to the action of a spring 439 which normally keeps the slider 438 bearing against a stop 441. Through the medium of a lug 443, a shoulder 442 causes a lever 444 to turn clockwise and releases the clutch 451 for a cycle of return by one stop. The spring 453 causes the lower 454 to turn anticlockwise until it is arrested against a shoulder 491 of a lever 493 pivoted at 494 by means of a lug 492.

The roller 457 loses contact with the cam 452 and the shaft 456 turns with the lever 454 and the lever 458 and, by means of the lever 221 (FIG. 8), shifts the slider 223 to the right together with the hook 143, the slider 137 and the escapement pawls 133, 134 and 135. These cause the rack 132 to move to the right for a distance slightly greater than one elementary step. The lever 159 (FIG. 11) releases, by means of a pin 163 the retaining dogs 164, 165 and 166, which temporarily engage the rack 132 for the actuation of springs 167. The cam 452 (FIG. 8) engages the roller 457 and causes the levers 454 and 458 to return to the rest position. The lever 221 restores now leftwards the slider 137 whereby the escapement pawls 133, 134 and 135 engage the rack 132 in a position back spaced one elementary step. The lever 159 (FIG. 11) returns to the rest position, disengaging the retaining dogs 164, 165 and 166 from the rack 132 and the carriage 130 remains in a position shifted to the right by one elementary step with respect to the original position, as described in the cited U.S. Pat. No. 3,288,262.

On the cam 452 (FIG. 1) there is fixed a pin 496 adapted to co-operate with a flat portion 497 of the slider 438 during a cycle of return by one step. On keeping the key 428 depressed after starting the cycle, the pin 496 engages the flat portion 497, depressing the slider 438, and the shoulder 442 ceases its engagement with the lug 443. A spring 446 brings the lever 444 back to rest and arrests the cycle after 360° by means of a lug 448 even if the key 428 is kept depressed. If the key 428 is depressed for an extra distance, the lever 436 is rotated further, whereby the slider 438 engages the lug 443 by means of a second shoulder 498 and the flat portion 497 is beyond the path of the pin 496 and the cycle of return by one step continues until the key 428 is released.

LOCATION OF THE PRINTING POINT

The device comprises a pointer 346 constituted by a substantially vertical wire; this is adapted to be positioned near to and aligned with the printing point to indicate the exact printing position to the operator. The pointer 346 is guided at the top in a hole 347 of a paper holder 348 and is fixed at the bottom of a pin 349 of a lever 351. The lever 351 can turn on a spindle 577 and has a lug 352 adapted to co-operate with one end 353 of a lever 354 which turns on a spindle 314 and co-operates with the striking cam 344 under the action of a spring 369.

A spring 359 normally keeps the lever 351 turned anticlockwise and arrested by means of a seat 361 against a lug 357 of a bail 358 which can turn on a spindle 303. The bail 358 is provided with a projection 366 which co-operates with a lever 367 fast with the shaft 456 under the action of a spring 368 which urges the bail 358 clockwise.

On depressing the key 428 for return by one step, the engagement of the clutch 451 and the rotation of the cam 452, as described hereinbefore, cause anticlockwise rotation of the shaft 456. The lever 367 then engages the projection 366 and turns the bail 358 anticlockwise in opposition to the action of the spring 368. The lug 357 releases the seat 361 and the spring 359 turns the lever 351 anticlockwise, raising the pointer 346. This is facilitated by the action of the lug 357 on an edge 360 of the lever 351 which is disposed in front of the seat 361. The spring 359 holds the pointer 346 in the raised position with a projection 356 arrested against the lug 357, as shown in FIG. 2, while the bail 358, in turn, remains arrested by the same projection 356 even after the return of the lever 454 (FIG. 1) to the rest position.

In order to bring the pointer 346 back to the rest position, it is sufficient to start a typing cycle. In this case, the rotation of the striking cam 344 causes, by means of the spring 369, the rotation of the levers 354 and 351 and the release of the bail 358 until the lug 357 is engaged in the seat 361. The pointer 346 is thus held in the unset position even after the return of the cam 344 to the rest position.

The above-described device is particularly useful in machines provided with a single type-bearing element, as already described. In these machines, the printing point is not easily identifiable by the operator because of the absence of reference elements sufficiently close to the printing point. Moreover, it is also useful and practical in machines equipped with hammers, in which, even if the usual guide for the type hammers is present as a reference, it is not aligned with the typing or printing line. In the case of hammer-type machines, the function which is entrusted here to the common striking cam 344 may be performed by the universal tab or by similar striking members in a manner which can readily be mechanised by experts in this field.

CORRECTING DEVICE

A correcting key 16 (FIG. 3) is connected to a slider 592 which is normally held arrested by a hook 593 in opposition to the action of a spring 594. The slider 592 has a projection 602 adapted to co-operate with a lug 603 of the release lever 444 of the service clutch 451, and a lug 604 adapted to arrest a lug 606 of a hook 607 on which a spring 611 acts. The hook 607 is pivoted on a pin 608 of a positioner or bail 609 which can turn on a spindle 694.

A spring 696 (FIG. 4) keeps a cam-following lever 614, which is pivoted on the spindle 694, turned anticlockwise, with a roller 617 in contact with a service cam 618 which is also carried by the service clutch 451. The cam-following lever 614 moreover has a lug 619 adapted to co-operate with the hook 607.

The bail 609 (FIG. 3) is connected by means of a slotted hole 621 to a pin 622 of a lever 623 fixed on a shaft 624, to which there is also fixed a lever 626 adapted to co-operate with a lug 627 of the lever 422. A suppressor or lever 629 pivoted on the shaft 624 is kept turned clockwise by a spring 628, with a lug 631 arrested against a shoulder 632 of the lever 626. The lug 631 is moreover adapted to arrest a shoulder 633 of the pull rod 402 in the striking cycle, in order to prevent movement of the carriage 130.

Two ribbon-raising forks 638, which hold a correcting ribbon 658, are fast with each other through the medium of a spindle 242. Under the action of a spring 639, one of the two forks 638 is normally kept arrested by a pin 637 against a cam end 636 of the bail 609. This fork 638 moreover has a second pin 641 adapted to co-operate with a correcting-ribbon raising cam 642 fixed on the shaft 336, and a lug 643 adapted to co-operate with a shoulder 644 of a pawl 646.

Figure 6:
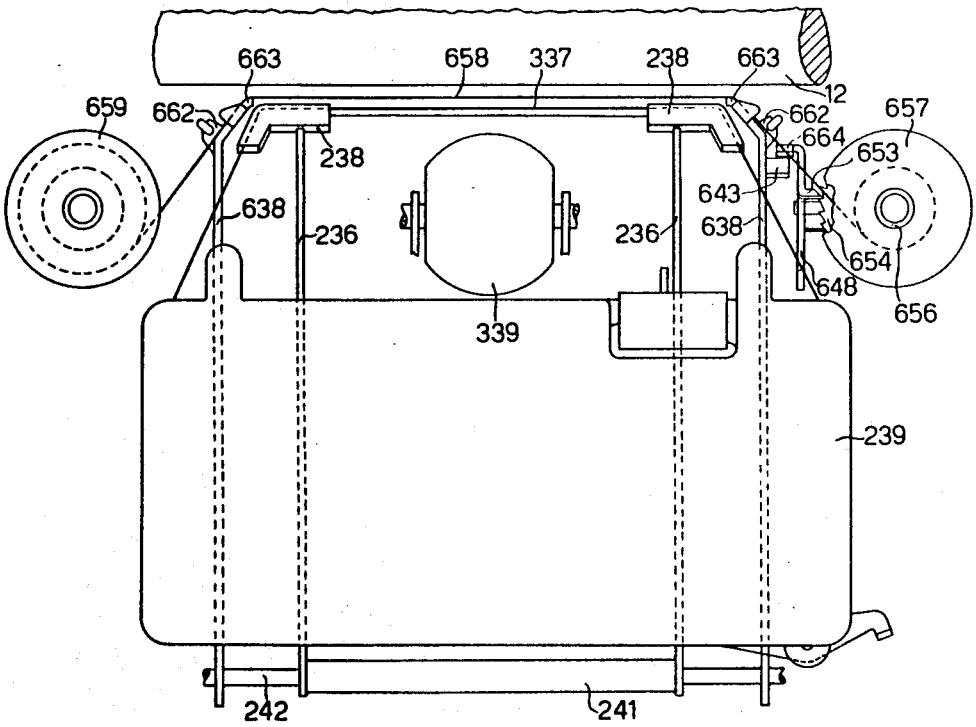
FIG. 6 is a plan view of a number of details of FIG. 3.

The pawl 646 is constituted by a bail movable radially and axially on a spindle 647 mounted on a lug 648 of a fixed plate 649. A spring 651 normally keeps the pawl 646 turned clockwise, arrested with a shoulder 652 against the plate 649. The pawl 646 has a wedge-shaped end 653 (FIG. 6) normally engaged with a saw-tooth ratchet wheel 654 fast with a sleeve 656 driving a take-up spool 657 for the correcting ribbon 658. This ribbon 658 is wound on a feed spool 659 rotatable on the plate 649 (FIG. 3) and is guided by two guides 662 (FIG. 6) of the forks 638 and rewound on the take-up spool 657.

More particularly, each guide 662 comprises an end 663 for guiding the correcting ribbon 658 substantially parallel to the platen 12, two lugs 664 (FIG. 4), an upper and a lower lug, respectively, and an L-shaped element 666 for keeping the correcting ribbon 658 tensioned in a vertical plane.

Figures 3, 9:
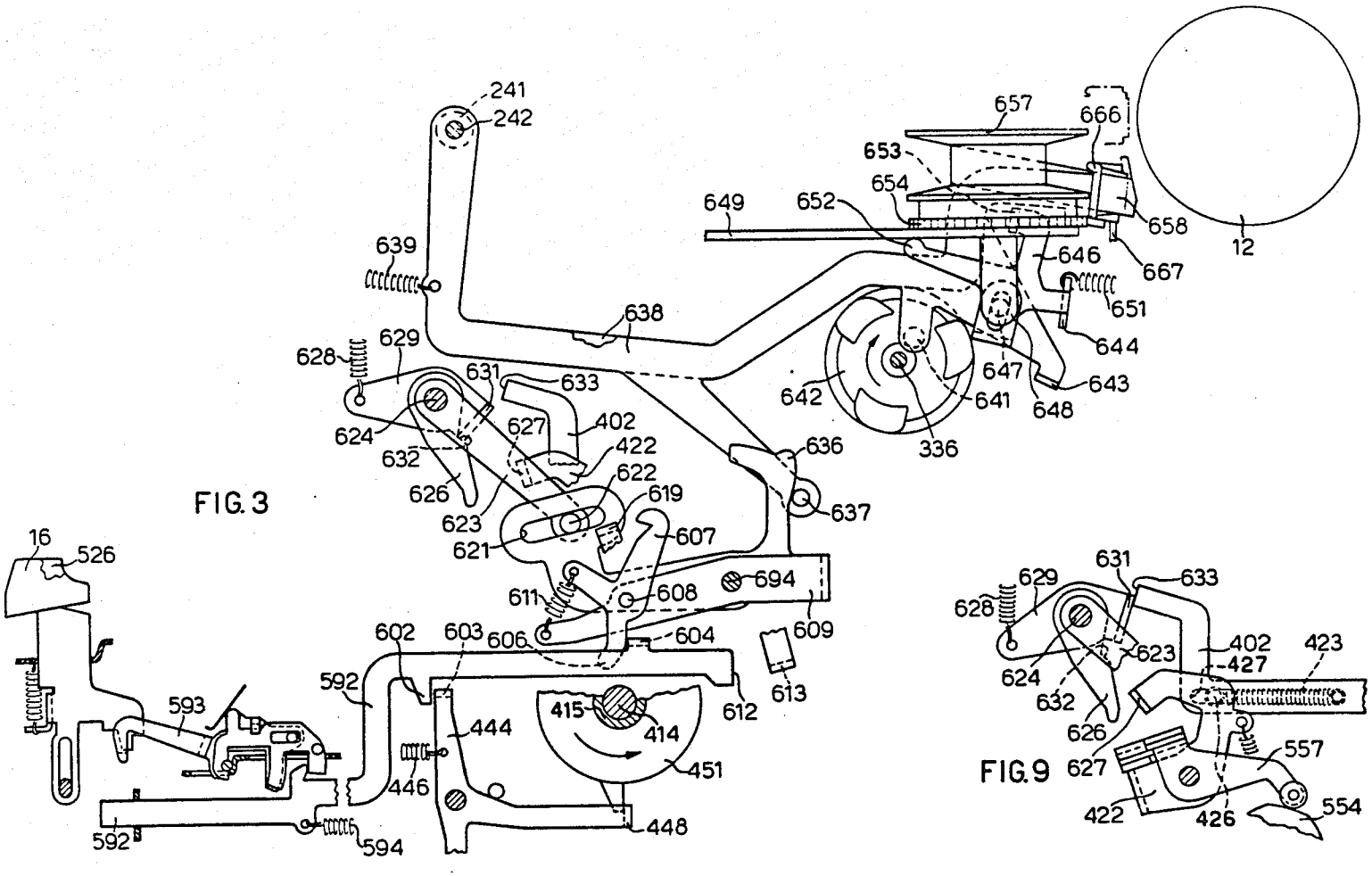
FIG. 3 is another partial longitudinal section of the machine of FIG. 1 comprising a correcting device.
FIG. 9 is a view of a number of details of FIGS. 1 and 3 in a working position.
Figure 7:
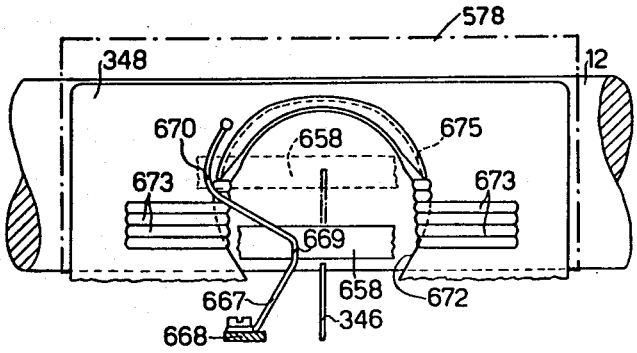
FIG. 7 is a front view of a number of details of FIGS. 1 and 3.

To prevent the correcting ribbon 658 touching the typing ribbon 337 during the raising movement, as described hereinafter, a control element 667 is provided which is constituted by a rigid wire fixed to a lug 668 (FIG. 7) of the frame of the machine. The element 667 has a portion 669 below the printing point for holding the correcting ribbon 658, in the proximity of the printing point, in an inclined position as shown in FIG. 3 and spaced from the platen 12 in the inoperative position. Finally, the element 667 has a portion 670 disposed to one side of the printing point substantially parallel to the platen 12 for holding the correcting ribbon 658 very close to the platen 12 and parallel thereto during a working position, as shown in dashes in FIG. 7, without impeding the striking of the head 339.

The paper holder 348 is fixed to the frame of the machine and has a substantially circular seat or window 672 (FIG. 7) in correspondence with the striking point. The holder 348 has an inner surface (FIG. 4) substantially parallel to the platen 12 and, in the upper part of the seat 672, is provided with a slightly projecting "eyelid" 675 (FIG. 7) inclined towards the inner surface of the said holder 348, "eyelid" 675 occupying a little less than one half of the seat 672 and having its ends radiused. This "eyelid" 675 facilitates the introduction of sheets of paper 578 over the platen 12, preventing the possibility of the corners becoming crumpled and spoiling the sheets.

A series of grooves 673 of hollow circular section are formed in the outer surface of the paper holder 348, at the edges of the seat 672, substantially parallel to the platen 12 and are adapted to collect and/or carry away the dirt which is produced by the use of the correcting ribbon 658. In this way, this dirt is prevented from interfering with correct oscillation of the ribbon 658 itself.

When it is desired to correct the last character typed, the correcting key 16 (FIG. 3) is depressed. The hook 593 then releases the slider 592, which is pulled back by the spring 594 and turns the lever 444 by means of the projection 602 and starts the clutch 451. The lug 604 releases the lug 606 and the spring 611 causes the hook 607 to turn anticlockwise and arranges it in the path of the lug 619.

The service cam 618 (FIG. 4) now causes the cam-following lever 614 to turn clockwise in opposition to the action of the spring 696 and carries with it the bail 609. A lug 613 moreover engages a shoulder 612 (FIG. 3) of the slider 592, causing the latter to slide forward into the inoperative position, coupled with the hook 593 again.

Figures 4, 5:
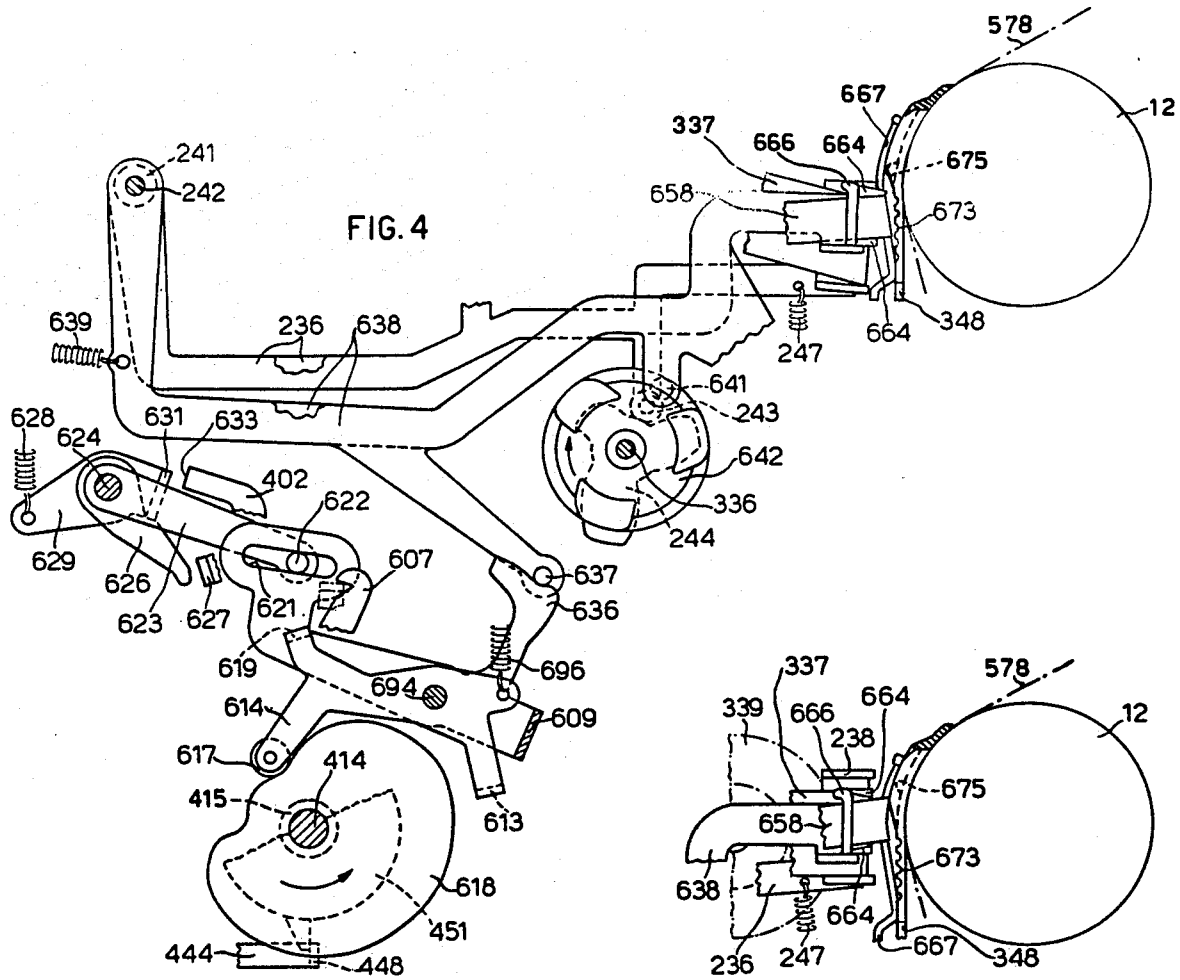
FIG. 4 is another partial section of the device of FIG. 3 in a first working position.
FIG. 5 is a longitudinal view of a number of details of FIG. 4 in a second working position.

By means of the slotted hole 621 and the pin 622, the bail 609 (FIG. 3) causes the lever 623, the shaft 624, and the lever 626 and the lever 629 to turn anticlockwise in opposition to the action of the spring 628, disposing the lug 631 in the path of the shoulder 633 of the pull rod 402, as shown in FIG. 4. Moreover, by means of the cam end 636, the bail 609 causes the correcting-ribbon raising forks 638 to turn anticlockwise, positioning the pin 637 in a saddle of the cam 636. The pin 641 therefore rises together with the forks 638 and the correcting ribbon 658, which is prearranged in turn in an intermediate position, guided by the control element 667, as shown in FIG. 4.

The cam 452 (FIG. 1) for return by one step controls, via the lever 454, the shaft 456 and the lever 458, the return of the rack 132 by one step, positioning the printing point in correspondence with the character to be erased. At the same time, the lever 367 causes the bail 358 to turn anti-clockwise and releases the lever 351, setting the pointer 346 at the printing point.

Before the re-opening or disengagement of the clutch 451, the cam-following lever 614 (FIG. 4) has removed the lug 619 from the hook 607, but the bail 609 remains in the working position, as shown in FIG. 4. The action of the spring 639 on the bail 609 through the medium of the forks 638, the pin 637 and the saddle of the cam portion 636 prevails, in fact, over the action exerted by the spring 628 on the same bail 609 through the agency of the lever 629. Therefore, even with the clutch 451 disengaged, the correcting ribbon 658 remains prearranged in the position intermediate between the low inoperative position and the high operative position, as shown in FIG. 4.

By now depressing the alphanumeric key 413 (FIG. 1) corresponding to the character to be erased, in addition to the selection of this character on the head 339, the rotation of the three-lobed cam 244 (FIG. 4) and the raising of the ribbon 337 in front of the printing point is produced. Simultaneously, the cam 642 (FIG. 4) engages the pin 641 and raises the forks 638, also disposing the correcting ribbon 658 behind the ribbon 337, i.e. between the typing ribbon 337 and the platen 12. In the meantime, the cam 419 (FIG. 1) has slightly rotated the lever 422 and has shifted the pull rod 402 forward. The lug 631 arrests the pull rod 402, as shown in FIG. 9, after a travel insufficient to withdraw the pawls 133 to 135 from the rack 132.

During the raising of the forks 638 (FIG. 3), the lug 643 engages the shoulder 644 and causes the pawl 646 to turn anticlockwise in opposition to the action of the corresponding spring 651. The end 653 (FIG. 6) engages the saw-toothed wheel 654, causes it to rotate anticlockwise and causes the correcting ribbon 658 to advance by one step. The cam 344 (FIG. 1) then produces the striking of the selected character against the platen 12, which takes place with the transport both of the typing ribbon 337 (FIG. 5) and of the correcting ribbon 658. When the striking action has taken place, if the correcting ribbon 658 is of the lift-off type, it removes the ink deposited by the previously imprinted character and if, on the other hand, it is of the cover-up type, it deposits a covering layer over the previously imprinted character, while the pointer 346 returns to the lowered position.

The escapement cam 419 (FIG. 1) now causes the cam-following lever 421 and the lever 422 to turn further, loading the spring 423 further without this having any effect on the movement of the pull rod 402, which is kept stationary by the lug 631. The carriage 130 therefore also remains stationary. Almost at the end of its stroke, the lug 627 of the lever 422 engages the lever 626 (FIG. 9) and rotates it clockwise together with the shaft 624 and the lever 623. Through the medium of the connection formed by the pin 622 (FIG. 3) and the slot 621, the lever 623 causes the bail 609 to turn anticlockwise and brings it back to the inoperative position, as shown in FIG. 3. The lever 629, on the other hand, remains in the operative position through the agency of the spring 423 (FIG. 9), which keeps the pull rod 402 arrested with its shoulder 633 against the lug 631 and the action of which prevails over that of the spring 628 on the lever 629.

Almost at the end of the cycle, the lever 422 brings the pull rod 402 back to the inoperative position and the spring 628 brings the lever 629 back to the inoperative position and arrests the lug 631 against the shoulder 632 out of the path of the pull rod 402, while the spring 639 (FIG. 3) brings the correcting ribbon 658 back to the inoperative position.

Fresh depression of an alphanumeric key 413 (FIG. 1) commands a typing cycle similar to what has been previously described, but since the lug 631 (FIG. 3) has returned to the inoperative position, the pull rod 402 is no longer impeded and can withdraw the pawls 133 to 135 from the rack 132 (FIG. 8) and the carriage 130 can move in the normal manner.

In the case where the operator has depressed the correcting key 16 in error, prearrangement of the correcting ribbon 658, arrest of the escapement of the carriage 130 and return of the carriage 130 by one step for a typing cycle are obtained. To cancel this prearrangement, the space bar 526 is depressed and starts the spacing clutch 553 for a 180° rotation of the cam 554. By means of the levers 557 and 422 (FIG. 1), the spring 423 shifts the pull rod 402 until it is arrested against the lug 631. Thereafer, the lug 627 cooperates with the lever 626 and cancels the prearrangement of the correcting ribbon 658 as previously described. Moreover, since the cams 244 and 642 (FIG. 4) have remained stationary, neither raising of the two ribbons 357 and 658 nor feed thereof have taken place.

It is understood that various modifications may be made without departing from the scope of the invention as claimed. For example, the take-up spool 657 and the feed spool 659 (FIG. 6) may be accommodated inside the cartridge 239 by lengthening it suitably and modifying the guides 238 and 662 and shifting the mechanism of the pawl 646.

What we claim is:

1. In a typewriter having a typing mechanism for typing a selected character on a printing point of a sheet of paper, and an operable back space key for shifting the printing point back, a device for facilitating location of the printing point along a printing line comprising:

a pointer movable perpendicularly to said printing line between an inoperative position away from said printing point to an operative position aligned therewith and at a short distance from said printing point;

means for holding said pointer in either of said inoperative and said operative positions, respectively;

set means actuated by the operated back space key for moving said pointer from said inoperative position to the operative position jointly with the backward movement of the printing point and against the action of said holding means; and restoring means, actuated by said typing mechanism and operative on said pointer only in the operative position thereof for restoring said pointer to the inoperative position before the typing of the first selected character, whereby typing of following characters and manipulating of the sheet of paper are not disturbed by said pointer.

2. A typewriter according to claim 1, comprising a type head on which are disposed the characters to be printed, wherein the typing mechanism includes a striking cam for moving the type head to strike the selected character on the printing point, and wherein said restoring means comprise an intermediate element operated by said striking cam to bring said pointer from said operative position to the inoperative position before the striking movement of said type head.

3. A typewriter according to claim 1 having a platen supporting said sheet of paper, a typing head on which are disposed the characters to be printed, and a holder for holding the sheet of paper in contact with the platen, comprising a window in correspondence with the printing point for allowing the passage of the selected character of the typing head, and wherein said holder comprises guide means below said window and adjacent thereto for slidably guiding said pointer upon the vertical movement thereof.

4. A typewriter according to claim 3, wherein said pointer comprises a rigid wire and said guide means comprises a hole of said holder in which slides said wire.

5. In a typewriter having a typing mechanism for typing a selected character on a printing point, and an operable back space key for shifting the printing point back, a device for facilitating location of the printing point comprising:

a pointer movable between an inoperative position away from said printing point to an operative position aligned therewith;

set means actuated by the operated back space key for moving said pointer to the operative position jointly with the backward movement of the printing point; and restoring means actuated by said typing mechanism for restoring said pointer to the inoperative position before the typing of the selected character;

wherein said device further comprises a lever carrying said pointer and resilient means biasing said pointer carrying lever for setting the pointer from the inoperative position to the operative position; and wherein said set means comprise a stop lever movable between a first position, in which said stop lever arrests said pointer carrying lever in the inoperative position of said pointer against the action of said resilient means to a second position, in which said stop lever releases said pointer carrying lever and a releasing member actuated by the operated back space key for moving the stop lever from the first to the second position to set the pointer in the operative position under the biasing of the resilient means on said pointer carrying lever.

6. A typewriter according to claim 5, wherein the pointer carrying lever comprises a first cam portion engageable by the stop lever in the first position thereof to hold the pointer in said inoperative position and a second cam portion adjacent to said first cam portion wherein a retaining spring urges said stop lever from said second to said first position and said stop lever remains in engagement with the second cam portion of said pointer carrying lever, in the operative position of said pointer and wherein said restoring means opertes on said pointer carrying lever to bring the pointer to the inoperative position in opposition to the action of said resilient means and the retaining spring causes the stop lever to follow said second cam means to engagement with said first cam portion, when the pointer returns to the inoperative position.

7. In a typewriter having a paper support platen defining a printing point, a typing head movable with respect to the platen along a printing line for typing a selected character on the printing point, and a paper holder located in a fixed relationship with respect to the printing point along the printing line and movable with respect to the platen for holding a sheet of paper in contact with the platen comprising a window in correspondence with the printing point for allowing the passage of the selected character of the typing head, a device for facilitating location of the printing point comprising a pointer movable vertically with respect to the printing line and the platen from an inoperative position away from said printing point to an operative position nearer and aligned therewith, and guide means of said paper holder disposed below said window and adjacent said window for slidably guiding said pointer upon the vertical movement thereof.

8. A typewriter according to claim 7, wherein said pointer comprises a rigid wire and said guide means comprise a hole of said holder in which slides said wire.

9. In a typewriter having a platen defining a printing point along a printing line, a typing mechanism for typing a selected character on the printing point, and a correcting device comprising an operable correcting key for shifting the printing point back along the printing line, a correcting ribbon settable by the operated correcting key and a lift mechanism for raising the correcting ribbon up to the printing point for causing the typing mechanism to correct the typed character by striking on the printing point together with the raised correcting ribbon, a device for facilitating location of the printing point comprising:

a pointer movable perpendicularly to said printing line between an inoperative position away from said printing point and an operative position nearer and aligned therewith;

means for holding said pointer positioned in said inoperative position and in said operative position;

set means, actuated by said operated correcting key, for moving said pointer to the operative position against the action of said holding means jointly with the backward movement of the printing point and the setting of the correcting ribbon; and restoring means actuated by said typing mechanism for restoring said pointer to the inoperative position before the striking of said typing mechanism, against the action of said holding means.

10. In a typewriter of the type comprising a platen defining a printing point; type means for the typing of selected character on said printing point; actuatable escapement means for moving reciprocally said platen with respect to said printing point; an actuator operated by said type means for actuating said escapement means upon printing of selected characters during a typing cycle and a correcting device having an operable correcting key, a correcting ribbon, a correcting ribbon support for lifting the correcting ribbon from an inoperative position to a set position, a lift mechanism for raising the correcting ribbon from the set position to an operative position in front of said printing point, a suppressor movable between an inoperative position and an operative position, and means responsive to the operation of the correcting key for moving the suppressor into the operative position for arresting the movement of the actuator to lock the escapement means, jointly to the raising of the correcting ribbon into the operative position, the improvement comprising:

a reciprocating member operated by said type means along a direct and return stroke during a typing cycle;

an actuating spring operatively connected between said reciprocating member and said actuator for moving resiliently said actuator for actuating said escapement means upon printing of selected characters during a typing cycle, the arrest of said actuator by said suppressor causing a tensioning of said actuating spring during the direct stroke of said reciprocating member;

a return spring for returning said suppressor from said operative position to said inoperative position when the correcting ribbon is released from the operative position to the inoperative position;

a positioner actuated by the operated correcting key to move and hold the correcting ribbon support from the inoperative position to the set position of the correcting ribbon, said positioner leaving said support upon raising of the correcting ribbon in the operative position by the lift mechanism; and means operated by said positioner to hold the suppressor in the operative position, in opposition to the action of said return spring until said correcting ribbon remains in said set position and for releasing the suppressor when the correcting ribbon is raised by said lift mechanism into the operative position;

a tensioning of said actuating spring on said actuator, during the direct stroke of said reciprocating member causing said suppressor to remain in the operative position, avoiding actuation of the escapement means when the correcting ribbon is in the raised position and said actuator releasing the suppressor at the end of the return stroke of the reciprocating member for the return of said suppressor to the inoperative position under the action of said return spring.

11. A typewriter according to claim 10, wherein the correcting device comprises a feed spool and a take-up spool for winding said correcting ribbon, and the correcting ribbon support comprises two forks for guiding the correcting ribbon between the feed spool and the take-up spool, wherein the take-up spool has a toothed wheel integral and coaxial with said take-up spool, and wherein a pawl is supported on one of the two forks and normally engages with the toothed wheel to advance the correcting ribbon during its positioning from the inoperative position to the operative position.

12. A typewriter according to claim 11, wherein the correcting device further comprises a fixed support plate disposed in a position intermediate between the inoperative position and the operative position of the correcting ribbon, wherein the feed spool and the take-up spool are rotatable on the fixed support plate and wherein each of said two forks comprises an upper and a lower lug for guiding the correcting ribbon and an L-shaped element projecting from the lower lug having an end disposed adjacent the upper lug as to form a seat for guiding the correcting ribbon further.

13. In a typewriter of the type comprising a platen defining a typing point on a sheet of paper, a holder for holding the sheet of paper in contact with the platen adjacent the printing point, a typing head carrying a plurality of characters, and a typing ribbon for the typing of selected characters on the printing point, said holder comprising a window in correspondence with the typing point for allowing the passage of the selected character of the typing head, and a correcting device for the correction of typed characters comprising a correcting ribbon, a lift fork for moving said correcting ribbon from an inoperative position to an operative position and a control element disposed in front of said window adjacent said plate interposed between said inked ribbon and said correcting ribbon for normally keeping the correcting ribbon spaced from the inked ribbon in a low position and in a high position thereof and both in the inoperative position and in the operative position of said correcting ribbon.

14. A typewriter according to claim 13, wherein the control element comprises a rigid wire having a portion toward the printing point which holds the correcting ribbon inclined and distant from the platen, symmetrically with respect to the printing point, when the correcting ribbon is in the inoperative position and a second portion disposed to the side of the printing point which holds the correcting ribbon substantially parallel to the platen and close to the platen when the correcting ribbon is in the operative position.

15. In a typewriter of the type comprising a platen defining a printing point along a printing line, a typing head carrying a plurality of characters, a typing ribbon for typing a selected character on the printing point, and a correcting device having a correcting ribbon for the correction of typed characters, a paper holder for holding a sheet of paper in contact with the platen comprising a window in correspondence with the printing point for allowing the passage of the selected character of the typing head, and of the typing and correcting ribbons, a series of grooves substantially parallel to said printing line formed adjacent to said window, said grooves being in reciprocal contact with each other for simultaneously limiting the contact with the correcting ribbon for receiving the residues which are produced during correction of typed characters by the correcting ribbon.

* * * * *